US012559948B2

(12) United States Patent
Whispell

(10) Patent No.: US 12,559,948 B2
(45) Date of Patent: Feb. 24, 2026

(54) HOOKED TONGUE AND GROOVE LOCKING ARRANGEMENT FOR NON-METALLIC FLOORING ELEMENTS

(71) Applicant: AHF, LLC, Mountville, PA (US)

(72) Inventor: John M. Whispell, Mountville, PA (US)

(73) Assignee: AHF, LLC, Mountville, PA (US)

( * ) Notice: Subject to any disclaimer, the term of this patent is extended or adjusted under 35 U.S.C. 154(b) by 376 days.

(21) Appl. No.: 18/233,229

(22) Filed: Aug. 11, 2023

(65) Prior Publication Data

US 2024/0052642 A1 Feb. 15, 2024

Related U.S. Application Data

(60) Provisional application No. 63/371,169, filed on Aug. 11, 2022.

(51) Int. Cl.
*E04F 15/02* (2006.01)
*E04F 15/04* (2006.01)

(52) U.S. Cl.
CPC ..... *E04F 15/02038* (2013.01); *E04F 15/04* (2013.01); *E04F 2201/0115* (2013.01); *E04F 2201/023* (2013.01); *E04F 2201/043* (2013.01)

(58) Field of Classification Search
None
See application file for complete search history.

(56) References Cited

U.S. PATENT DOCUMENTS

2003/0084636 A1* 5/2003 Pervan ..... E04F 15/04 52/592.1
2003/0233809 A1* 12/2003 Pervan ..... E04F 15/02033 52/592.1
2011/0131916 A1* 6/2011 Chen ..... E04F 15/02 52/582.1
2011/0167744 A1* 7/2011 Whispell ..... B32B 5/024 52/309.1
2015/0337540 A1* 11/2015 Cappelle ..... E04F 15/105 52/309.1
2020/0362568 A1* 11/2020 Li ..... E04C 2/40

* cited by examiner

*Primary Examiner* — Gisele D Ford
(74) *Attorney, Agent, or Firm* — Budzyn IP Law, LLC

(57) ABSTRACT

The subject invention is directed to non-metallic flooring elements having a hooked-tongue and groove locking arrangement. Advantageously, the subject invention allows for horizontal interlocking, with no angled introduction needed. As a result, the same locking arrangement can be used for the sides and the ends of the flooring element. This allows for the use of two tools for manufacturing about the perimeter of the flooring element—one tool for the hooked-tongue element and one tool for the groove.

9 Claims, 7 Drawing Sheets

HOOKED TONGUE AND GROOVE LOCKING ARRANGEMENT FOR NON-METALLIC FLOORING ELEMENTS

CROSS-REFERENCE TO RELATED APPLICATION

This application claims priority to U.S. Provisional Patent Appl. No. 63/371,169, filed Aug. 11, 2022, the entire contents of which is incorporated by reference herein.

FIELD OF THE INVENTION

The subject invention relates to locking arrangements for flooring systems.

BACKGROUND OF THE INVENTION

Locking arrangements for flooring systems are well known in the prior art. These arrangements have included interlocking tongue and groove arrangements. Typically, prior art tongue-and-groove arrangements have required the tongue to be inserted into the groove at a high angle with downward rotation to insert the tongue into the groove. As a result, limitations are created, including in geometry of the flooring elements (e.g., limit in height of the flooring elements to avoid interference) and in installation. In addition, due to the angled introduction, these prior art systems typically require two different locking arrangements, one for longitudinal side edges and another for end connections, since the ability to rotate and interlock ends is limited.

SUMMARY OF THE INVENTION

The subject invention is directed to non-metallic flooring elements having a hooked-tongue and groove locking arrangement. Advantageously, the subject invention allows for horizontal interlocking, with no angled introduction needed. As a result, the same locking arrangement can be used for the sides and the ends of the flooring element. This allows for the use of two tools for manufacturing about the perimeter of the flooring element—one tool for the hooked-tongue element and one tool for the groove.

These and other features of the subject invention will be better understood through a study of the following detailed description and accompanying drawings.

DETAILED DESCRIPTION OF THE INVENTION

With reference to the Figures, a flooring element is shown and generally designated with reference number 10. The flooring element 10 is provided with a locking arrangement which allows for similarly formed flooring elements to be interlocked in forming a continuous floor. This locking arrangement is particularly well suited for non-metallic flooring, such as hardwood flooring, engineered hardwood flooring, and, synthetic flooring (e.g., vinyl flooring, rigid core vinyl flooring (having, for example, a SPC (stone plastic composite) core or a WPC (wood plastic composite) core), and so forth).

Figure 1:
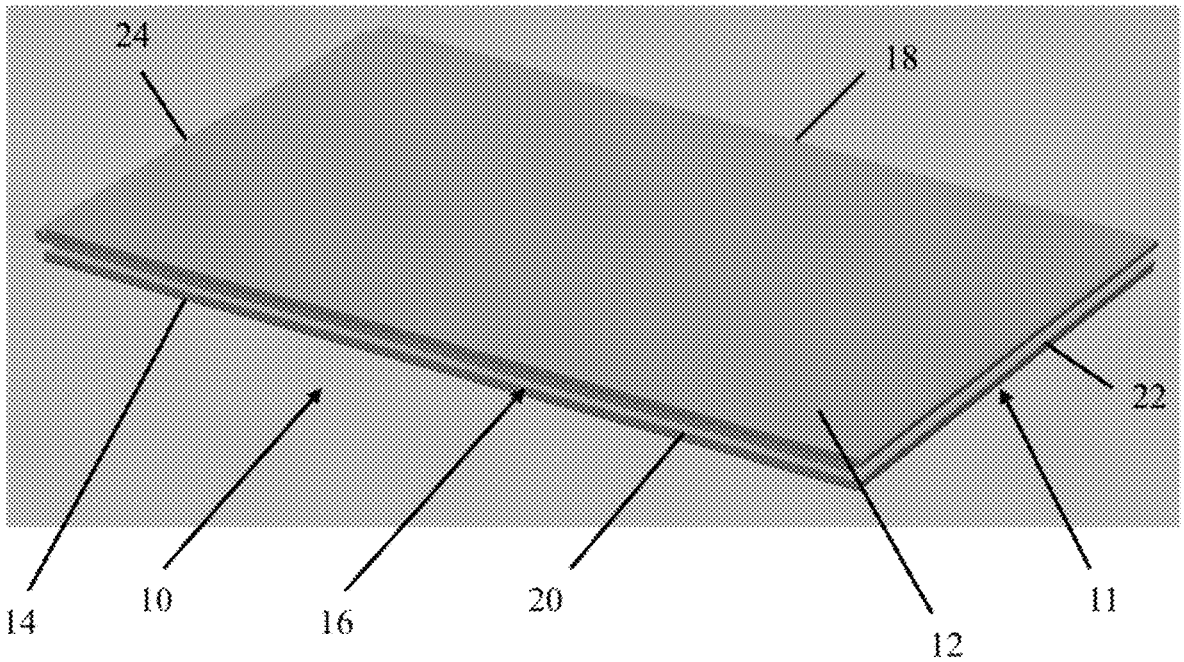
FIG. 1 shows a flooring element formed in accordance with the subject invention.
Figure 2:
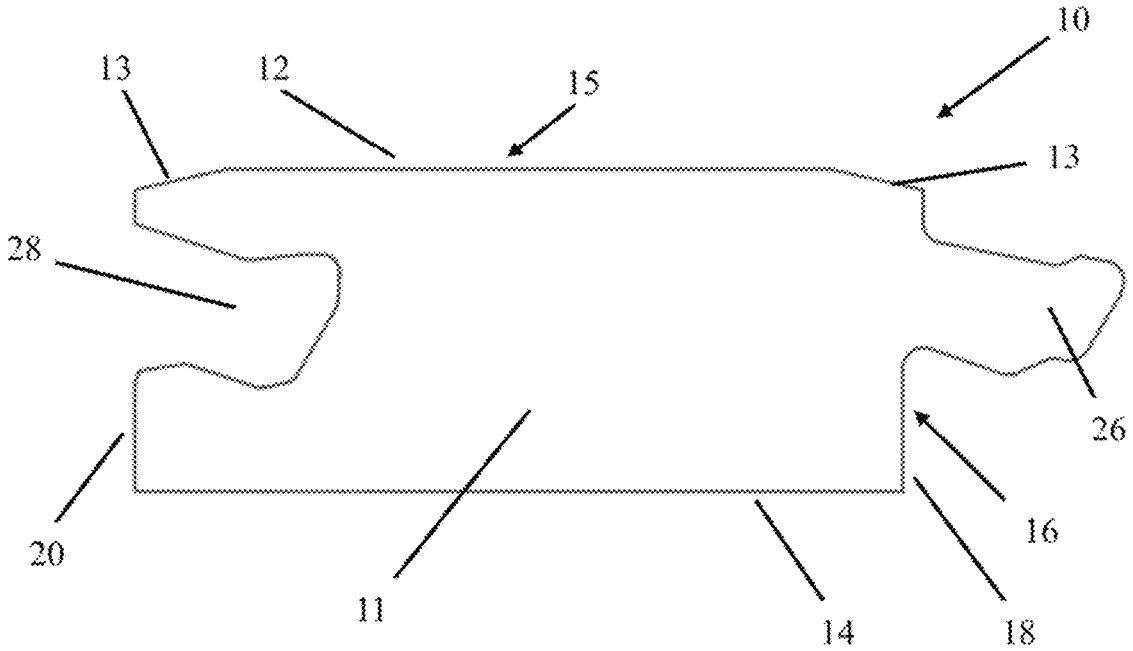
FIGS. 2-3 show a cross-sectional profile of a body of the flooring element formed in accordance with the subject invention.

As shown in FIGS. 1-2, the flooring element 10 includes a body 11 which is preferably plate-shaped having a top surface 12, a bottom surface 14, and an edge 16 extending therebetween. The flooring element 10 may be in the form of a tile, plank, or board. The flooring element 10 may be of any known flooring element construction, being composed of natural and/or synthetic materials, as known in the art. Accordingly, the body 11 may be at least partially formed of wood and/or the body 11 may be at least partially formed of synthetic material. In addition, the body 11 may be a single layer structure, being provided as a single layer of material such as wood, vinyl, and so forth. Alternatively, the body 11 may be a multi-layer structure having, for example, a core of one material located between layers of different materials. For example, a core of high-density fiberboard may be utilized located between natural wood veneers. As will be recognized by one skill in the art, the subject invention is not limited to a particular construction of the flooring element 10 or the body 11.

The flooring element 10 may include decorative layer(s), balance layer, and/or coating(s) (e.g, wear-resistant coating, waterproof coating, etc.) applied to the body 11.

The bottom surface 14 is preferably generally planar to provide a good resting surface for the flooring element 10. The flooring element 10 is installed with the bottom surface 14 applied against a subfloor or underlayment prepared to support the flooring element 10. The top surface 12 is generally planar but may include one or more tapered, chamfered, or rounded edges or portions 13, particularly along the edge 16. Once installed, the top surface 12 is upwardly exposed to be tread upon or otherwise be subject to use. Preferably, the majority of the top surface 12 is coplanar to define a major planar surface 15. It is noted that with no tapered, chamfered or rounded edges or portions 13, the entire top surface 12 may be coplanar defining the major planar surface 15. It is further preferred that the planar portions of the top and bottom surfaces 12, 14 be generally parallel. In particular, it is preferred that the major planar surface 15 of the top surface 12 be generally parallel to the bottom surface 14.

The edge 16 includes spaced-apart first and second side edge portions 18, 20 which extend between first and second end edge portions 22, 24. With the flooring element 10 having a rectangular shape, the first and second side edge portions 18, 20 are both provided with the same length with the first and second end edge portions 22, 24 also being provided with the same length. The spacing between the first and second side edge portions 18, 20 and the first and second end edge portions 22, 24 dictates the dimensions of the body 11, thus, dictating the dimensions of the flooring element 10. To allow for a plank or board shape, the first and second side edge portions 18, 20 are provided with longer length than the first and second end edge portions 22, 24. To allow for a square shape, for example, as a tile, the first and second side edge portions 18, 20 may be provided with the same length as the first and second end edge portions 22, 24. With a rectangular shape, generally right corners are defined at the intersections of the first and second side edge portions 18, 20 with the first and second end edge portions 22, 24, respectively.

As an alternative, the flooring element 10 may be provided with a non-rectangular, polygonal shape, including, non-rectangular quadrilateral shapes (such as rhomboidal or trapezoidal shapes), which are formed to shape-matingly engage in forming a continuous floor. The edge portions of these flooring elements are formed similarly to the edge portions described herein to achieve interlocking between adjacent flooring elements.

The locking arrangement of the subject invention utilizes a pair of lockable elements, namely a hooked tongue which is lockable with a groove. Preferably, with the body 11 having a rectangular shape, the pair of lockable elements are located on opposing portions of the edge 16. Thus, the first and second side edge portions 18, 20 may be provided with a pair of the lockable elements, and/or the first and second end edge portions 22, 24 may be provided with a pair of the lockable elements. In this manner, the flooring element 10 may be interlocked with similarly formed flooring elements along its sides and/or ends.

Figure 3:
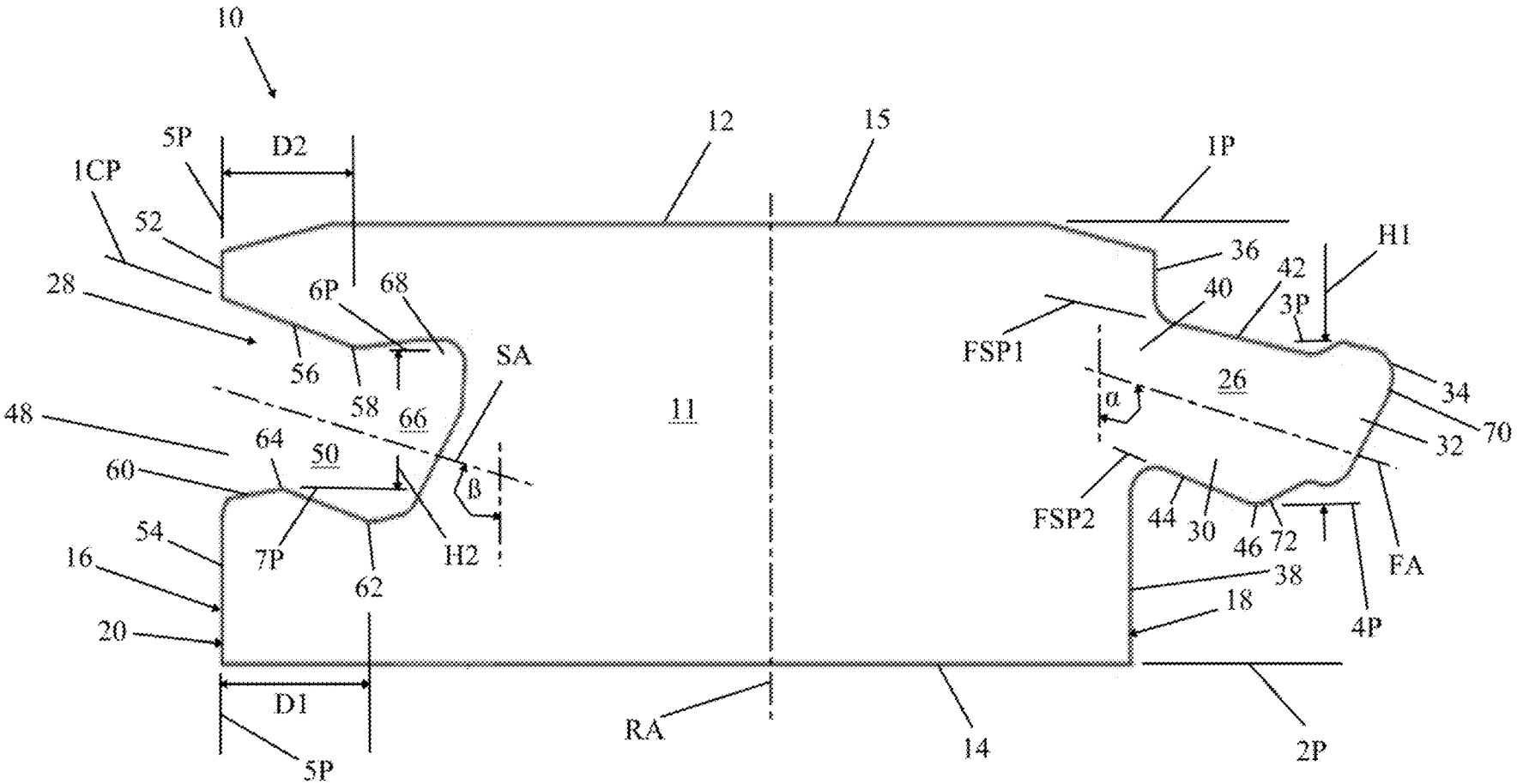

With reference to FIGS. 2 and 3, the profiles of the first and second side edge portions 18, 20 are shown on the body 11. The first side edge portion 18 is provided with tongue 26 and the second side edge portion 20 is provided with groove 28. For installation, the groove 28 is formed to lockingly receive the tongue 26 of an adjacent similarly formed flooring element, whereas, the tongue 26 is formed to be lockingly received in the groove 28 of an second adjacent similarly formed flooring element. The interlocking of the tongues and grooves between the flooring elements provides for locking therebetween. As will be understood by those skilled in the art, the tongue 26 and the groove 28 may be used interchangeably on the first and second side edge portions 18, 20. In addition, the first and second side edge portions 18, 20 are shown for illustrative purposes. The tongue 26 and the groove 28 may be equally used with the first and second end edge portions 22, 24, respectively.

With reference to FIG. 3, certain planes and axes are defined to describe the geometry of the tongue 26 and the groove 28. With respect to the top surface 12, at least a portion of the top surface 12, e.g, the major planar surface 15, coincides with a first reference plane 1P. Preferably, the first reference plane 1P coincides with a majority of the area of the top surface 12. In addition, at least a portion of the bottom surface 14 coincides with the second reference plane 2P. Preferably, the first and second reference planes 1P, 2P are generally parallel. There is also a primary reference axis RA disposed to be normal to the second reference plane 2P.

The tongue 26 includes a shank 30 with a hook 32 extending from the shank 30 to define a free end 34. The first side edge portion 18 includes a first wall 36 disposed transversely, preferably, normally, to the first reference plane 1P and a second wall 38 disposed transversely, preferably, normally, to the second reference plane 2P. The tongue 26 protrudes from the first and second walls 36, 38. Preferably, the tongue 26 protrudes from a base 40 located between the first and second walls 36, 38.

The shank 30 extends from the base 40 along a first reference axis FA which is disposed to intersect an axis parallel to the primary reference axis RA so as to subtend an acute angle $\alpha$ facing generally the second reference plane 2P and the first side edge portion 18. The shank 30 includes a first shank side surface 42 generally facing the first reference plane 1P and a second shank side surface 44 generally facing the second reference plane 2P. Preferably, the first and second shank side surfaces 42, 44 are each generally flat. A first shank reference plane FSP1 coincides with the first shank side surface 42, while a second shank reference plane FSP2 coincides with the second shank side surface 44.

The hook 32 is formed to extend upwardly from the shank 30 to define a hook shape. In particular, the hook 32 protrudes from the first shank reference plane FSP1 in a direction generally towards the first reference plane 1P. In addition, no portion of the hook 32 protrudes from the second shank reference plane FSP2 towards the second reference plane 2P. Accordingly, the hook 32 is provided wholly above the second shank reference plane FSP2 thereby limiting the downward extent of the tongue 26, and, thus, limiting the overall profile height thereof. This allows for horizontal insertion of the tongue 26 into the groove 28. With reference to FIG. 2, a tongue profile height H1 is defined between: i. a third reference plane 3P disposed normally to the primary reference axis RA to coincide with the portion of the free end 34 of the hook 32 located nearest to the first reference plane 1P, as measured normally to the first reference plane 1P; and, ii. a fourth reference plane 4P disposed normally to the primary reference axis RA to coincide with a junction 46 between the second shank side surface 44 and the hook 32.

The groove 28 includes an open mouth 48 from which extends channel 50. The second side edge portion 20 includes a third wall 52 disposed transversely, preferably, normally, to the first reference plane 1P and a fourth wall 54 disposed transversely, preferably, normally, to the second reference plane 2P. Preferably, the groove 28 is located between the third wall 52 and the fourth wall 54. The open mouth 48 may extend between the third wall 52 and the fourth wall 54. A fifth reference plane 5P coincides with the fourth wall 54.

The channel 50 extends from the open mouth 48 along a second reference axis SA disposed to intersect an axis parallel to the primary reference axis RA so as to subtend an obtuse angle facing generally the second reference plane 2P and the second side edge portion 20. The channel 50 is at least partially defined by a first channel wall 56 which extends along the channel 50 from the third wall 52 to a first inflection point 58. The first channel wall 56 may be flat and coincide with a first channel reference plane 1CP.

A second channel wall 60 extends along the channel 50 from the fourth wall 54 to a termination point 62. The termination point 62 is located at a first distance D1 from the fifth reference plane 5P, as measured normally relative to the fifth reference plane 5P. The first inflection point 58 is located at a second distance D2 from the fifth reference plane 5P, as measured normally relative to the fifth reference plane 5P. Preferably, the first distance D1 is greater than the second distance D2.

The second channel wall 60 defines a second inflection point 64 between the fourth wall 54 and the termination point 62. The second inflection point 64 represents the closest point of the second channel wall 60 to the first reference plane 1P, as measured normally relative to the first reference plane 1P. The termination point 62 may be the point of the second channel wall 60 which is furthest from the first reference plane 1P, as measured normally relative to the first reference plane 1P. The length of the second channel wall 60 between the second inflection point 64 and the termination point 62 may be generally parallel to the first channel wall 56. Alternatively, the length of the second channel wall 60 between the second inflection point and the termination point 64 may be arranged to converge with the first channel wall 56 along the second reference axis SA in a direction towards pocket 66, as described below.

The groove 28 includes a pocket 66 which extends from the channel 50. The pocket 66 includes a first pocket portion 68 which protrudes from the first channel reference plane 1CP in a direction generally towards the first reference plane 1P.

With respect to the groove 28, a throat height H2 is defined between: i. a sixth reference plane 6P disposed normally to the primary reference axis RA to coincide with the first inflection point 58; and, ii. a seventh reference plane 7P disposed normally to the primary reference axis RA to coincide with the second inflection point 64. Preferably, the tongue profile height H1 is greater than the throat height H2. This arrangement restricts the extraction of the hook 32 once received within the groove 28.

Figure 4:
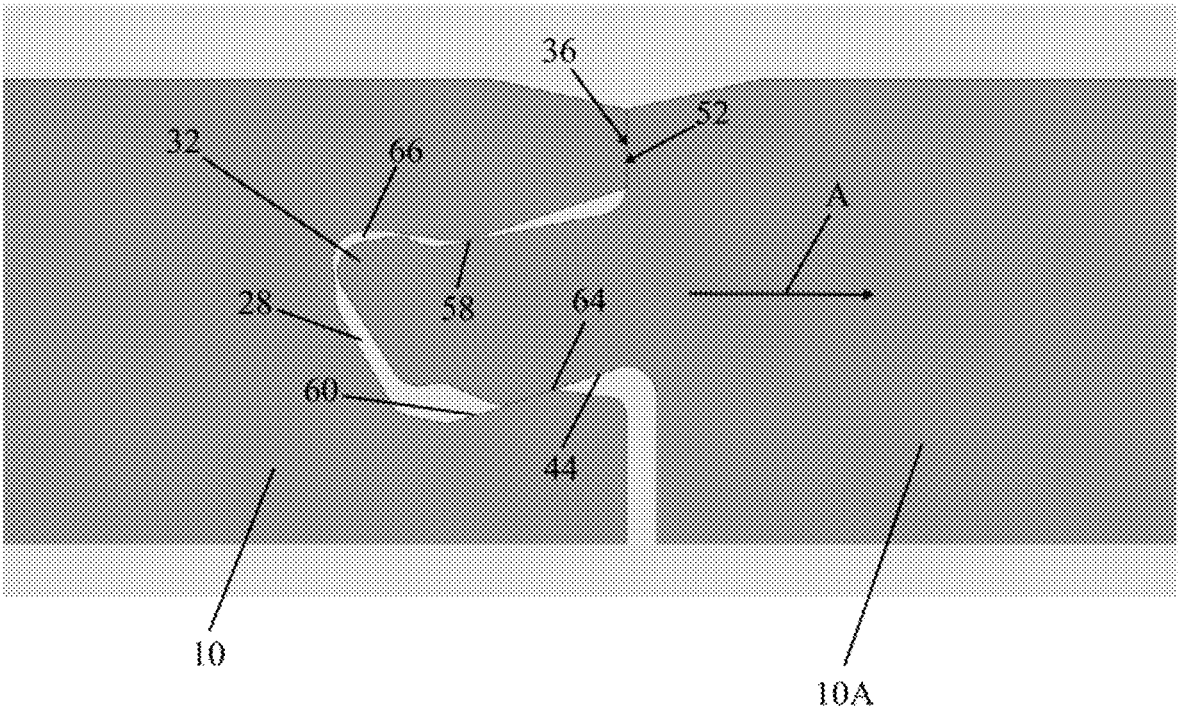
FIG. 4 shows a tongue and groove interlocked in accordance with the subject invention.

As a result of the geometries of the tongue 26 and the groove 28, as shown in FIG. 4, the groove 28 of the flooring element 10 is formed to lockingly receive the tongue 26 of an adjacent flooring element 10A, particularly with the hook 32 of the tongue being seated in the pocket 66 of the groove 28. Elements of the tongue 26 and the groove 28 are situated to interferingly engage in resisting separation. For example, a separating force, represented by arrow A, is counteracted by: i. interference between the second shank side surface 44 and the second channel wall 60, particularly, inwardly of the second inflection point 64; and, ii. interference between the hook 32 and the first inflection point 58. These two interferences may simultaneously coact, or act in varying individual capacities, to resist removal of the tongue 26 from the hook 32.

As shown in FIG. 3, the hook 32 may define end wall 70 which extends from the free end 34 towards the second reference plane 2P. A secondary end wall 72 may extend between the junction 46 and the end wall 70. As shown in FIG. 3, the secondary end wall 72 may be indented towards the first reference plane 1P. The indentation provides a bit of clearance along the heel of the hook 32 to facilitate insertion of the tongue 26 into the groove 28.

Figure 5:
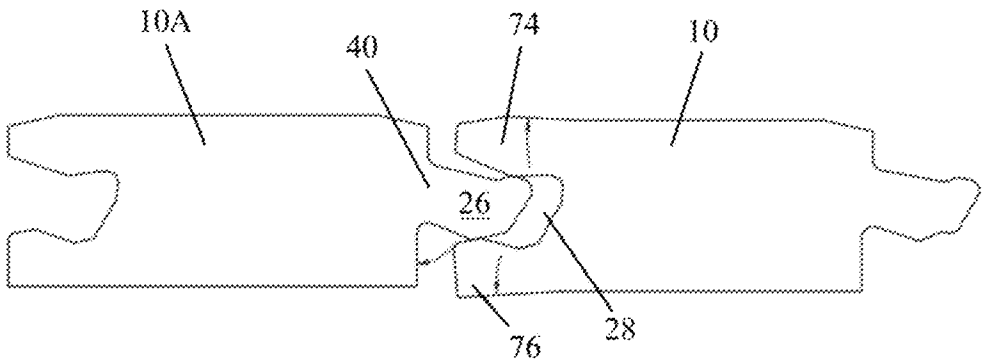
FIGS. 5-6 show two flooring elements formed in accordance with the subject invention being assembled.

As shown in FIG. 5, the locking arrangement of the subject invention allows for horizontal assembly of the flooring elements 10, 10A. Portions of the body 11 above and below the groove 28 define upper and lower cantilevered arms 74, 76 which are deflectable, as shown by the arrows, in response to the tongue 26 being inserted horizontally into the groove 28. In addition, the tongue 28 is deflectable about the base 40, particularly downwardly deflectable as shown by the arrow. This collective action allows for the tongue profile height H1 to pass through the throat height H2 with the hook 32 being received in the pocket 66. The constituent material of the body 11 must be sufficiently compliant to allow for deflection of one or more of the tongue 26, the upper cantilevered arm 74, and the lower cantilevered arm 76. In addition, the constituent material of the body 11 must be sufficiently resilient to recover towards the undeflected state. To facilitate deflection of the tongue 26 about the base 40, the first and second shank side surfaces may diverge in a direction away from the base along the first reference axis FA.

Figure 6:
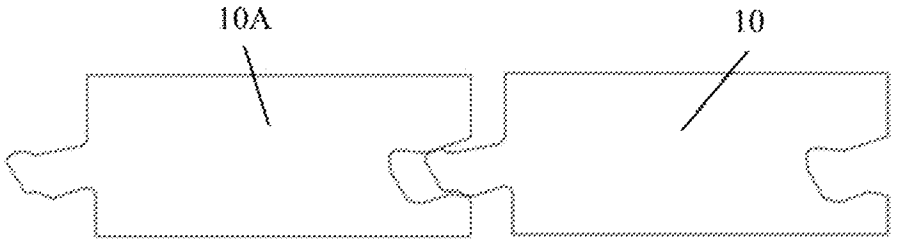
Figure 7:
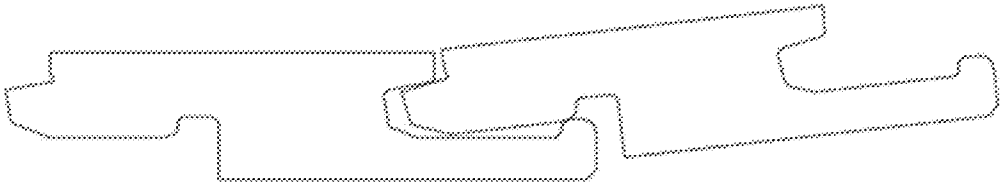
FIGURE 7 (PRIOR ART)
FIG. 7 shows a prior art arrangement of two flooring elements being assembled.

FIG. 6 shows horizontal assembly of the flooring elements 10, 10A. In contrast, as shown in FIG. 7, prior art assembly has required introduction of a tongue element at a relatively high angle, with subsequent downward rotation. The subject invention avoids the need for angled introduction. As a result, the locking arrangement of the subject invention may be used equally on longitudinal sides of a flooring element, as well as, along the ends of the same flooring element.

It is noted that the length of the first side shank surface 42 is selected to ensure that the hook 32 is located past the first inflection point 58 with the tongue 26 received in the groove 28. In addition, it is noted that the length of the second side shank surface 44 is selected to ensure that the junction 46 is located past the second inflection point 64 with the tongue received in the groove 28. The pocket 66 is formed with sufficient depth to fully accommodate the hook 32. Preferably, clearance is provided about the hook 32, with the hook 32 in the pocket 66, to ensure that the full length of the tongue 26 may be properly received in the groove 28. Contact of the tongue 26 against the rear wall of the groove 28, along the pocket 66, should be avoided. This contact may cause the tongue 26 to partially extend from the adjacent flooring element, resulting in an unwanted gap between flooring elements. Face-to-face engagement, or near face-to-face engagement, between the first wall 36 of the flooring element 10A and the third wall 52 of the flooring element 10, as shown in FIG. 4, is desired.

It is further noted that the third and fourth walls 52, 54 may be provided to be generally coplanar. The first and second walls 36, 38 may be likewise coplanar. Alternatively, the first and second walls 36, 38 may be offset with the second wall 38 being located inwardly of the first wall 36 (i.e., the second wall 38 may be located to be closer to the opposing edge than the first wall 36). Here, the first and second walls 36, 38 may be each generally planar, with the planes being generally parallel. The inwardly-offset second wall 38 provides a relief for the tongue 26 in accommodating downward deflection thereof, as discussed above.

Figure 8:
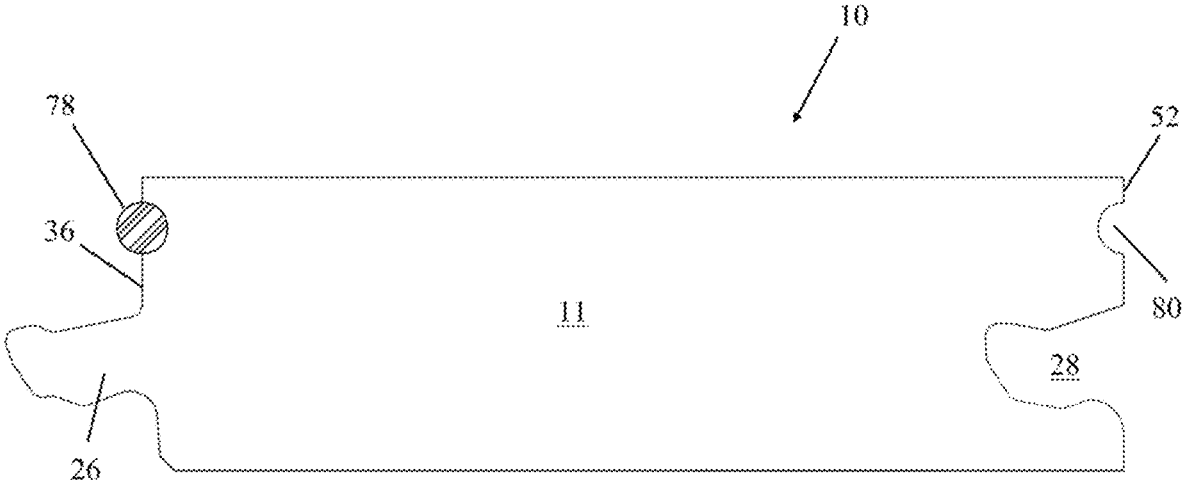
FIGS. 8-10C show various configurations of the subject invention.
Figure 9:
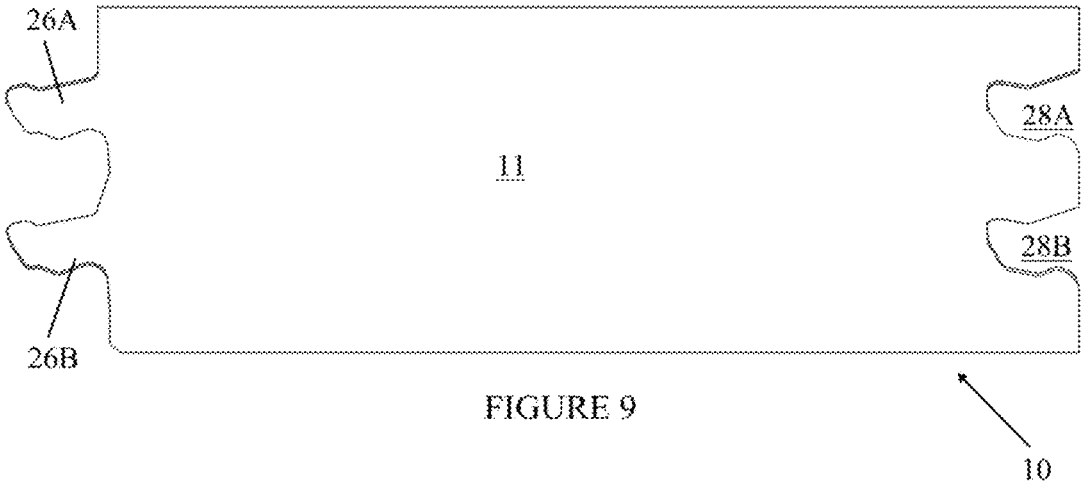

As will be appreciated by those skilled in the art, the tongue 26 and the groove 28 may be scaled in size or otherwise adjusted, based on particular applications, within the scope of the invention. With reference to FIG. 8, the elevation of the tongue 26 and the groove 28 along the height of the body 11 may be adjusted to accommodate other elements, such as a seal 78 receivable in seal groove 80 between adjacent flooring elements. In addition, as shown in FIG. 9, more than one tongue 26/groove 28 combination may be used, such as, two tongues 26A, 26B and two grooves 28A, 28B may be utilized. With horizontal assembly, the tongues 26A, 26B may be simultaneously received in the grooves 28A, 28B.

Figure 10A:
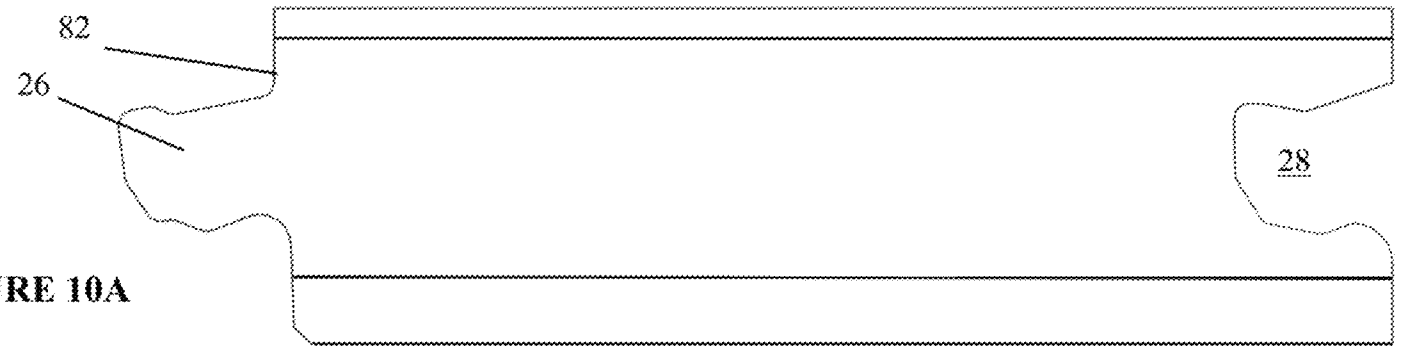
Figure 10B:
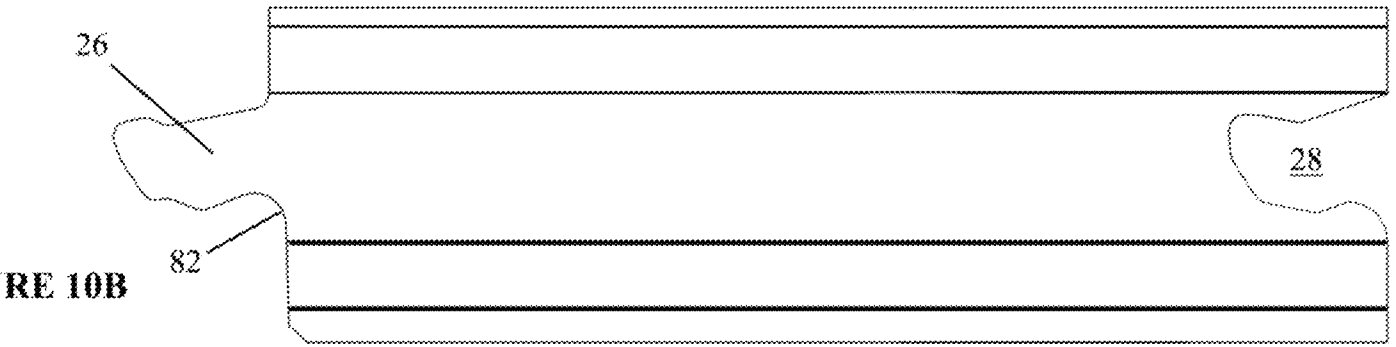
Figure 10C:
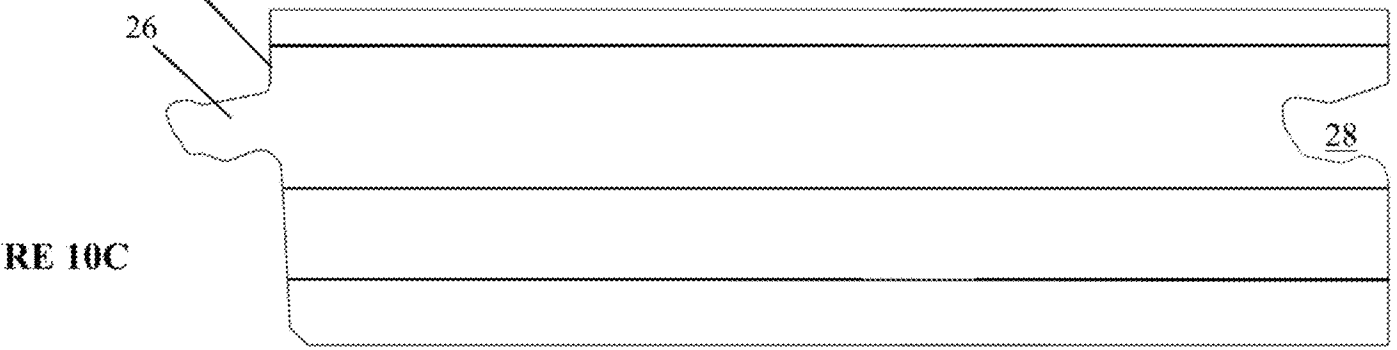

As shown in FIGS. 10A-10C, the tongue 26 and the groove 28 may be configured to reside in a particular layer of the body 11, particularly where the body 11 is a multi-layered construct. For example, the tongue 26 and the groove 28 may be formed in a core 82, where the core 82 is made of robust material. The core 82 may be formed of cellulosic material (such as high, medium, or low density fiberboard), stone plastic composite, and/or wood plastic composite. In forming the flooring element 10, the core 82 may be located between other layers, such as a decorative overlay, one or more veneers, a balance layer, and/or one or more coatings (e.g., scratch resistant coating, water resistant coating, etc.). The core 82 may be more robust than the other layers provided with the core 82 in forming the flooring element 10.

Figure 11:
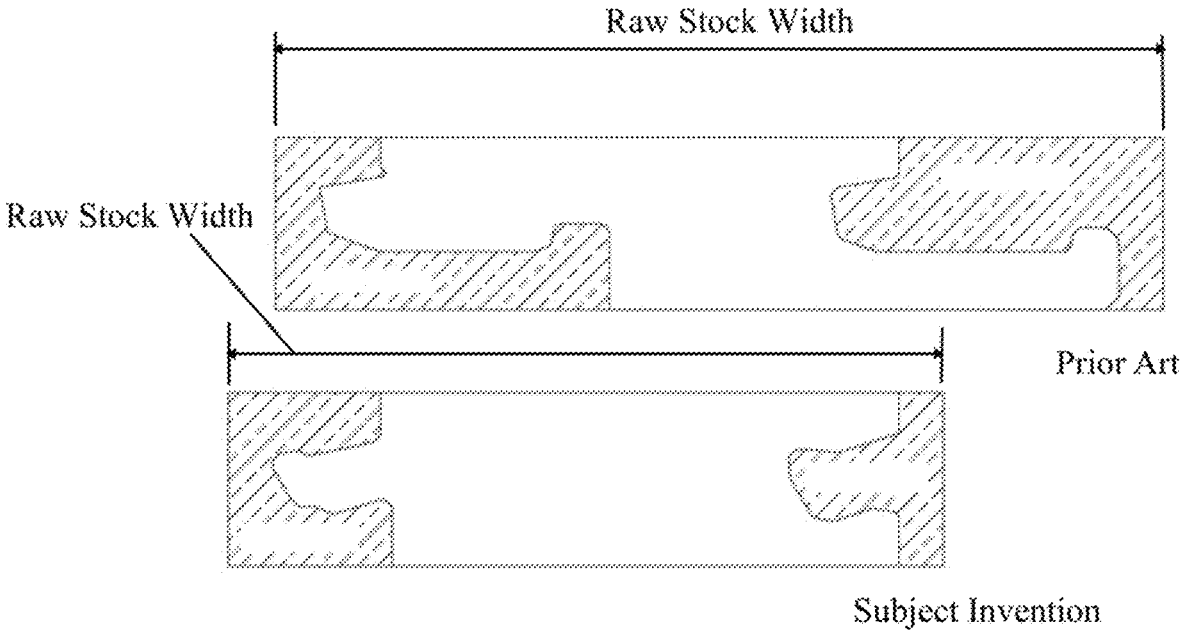
FIG. 11 shows schematically waste yielded from the manufacturing of the subject invention and a prior art design.

With reference to FIG. 11, it is noted that the subject invention reduces waste, which is shown in cross-hatching, resulting from manufacturing. As shown, a prior art design requires a wider piece of raw stock from which the flooring element may be machined, as compared to the subject invention. More waste is yielded from the manufacture of the prior art design than with manufacture of the subject invention. Overall, the subject invention provides a more compact profile for a flooring element.

What is claimed is:

1. A non-metallic flooring element comprising:

a plate-shaped rectangular body with opposing top and bottom surfaces with an edge extending therebetween, a first reference plane coinciding with at least a portion of the top surface, a second reference plane coinciding with at least a portion of the bottom surface, and a primary reference axis normal to the second reference plane, wherein, the edge includes spaced-apart first and second side edge portions extending between spaced-apart first and second end edge portions, wherein, the first side edge portion includes:

a first wall disposed transversely to the first reference plane;

a second wall disposed transversely to the second reference plane; and, a tongue protruding from the first and second walls, the tongue protruding from a base located between the first and second walls, the tongue including:

a shank extending from the base along a first reference axis disposed to intersect an axis parallel to the primary reference axis so as to subtend an acute angle facing generally the second reference plane and the first side edge portion, the shank including a first shank side surface facing generally the first reference plane and a second shank side surface facing generally the second reference plane, wherein, a first shank reference plane coincides with the first shank side surface and a second shank reference plane coincides with the second shank side surface; and, a hook extending from the shank to define a free end, wherein the hook protrudes from the first shank reference plane in a direction generally towards the first reference plane with no portion of the hook protruding from the second shank reference plane in a direction generally towards the second reference plane, wherein, a tongue profile height is defined between: i. a third reference plane disposed normally to the primary reference axis to coincide with a portion of the free end of the hook located nearest the first reference plane, as measured normally to the first reference plane; and, ii. a fourth reference plane disposed normally to the primary reference axis to coincide with a junction between the second shank side surface and the hook, wherein, the second side edge portion includes:

a third wall disposed transversely to the first reference plane;

a fourth wall disposed transversely to the second reference plane, wherein, a fifth reference plane coincides with the fourth wall; and, a groove located between the third and fourth walls, the groove including:

an open mouth between the third and fourth walls;

a channel extending from the open mouth along a second reference axis disposed to intersect an axis parallel to the primary reference axis so as to subtend an obtuse angle facing generally the second reference plane and the second side edge portion, the channel being at least partially defined by:

a first channel wall extending along the channel from the third wall to a first inflection point, a first channel reference plane coinciding with the first channel wall;

a second channel wall extending along the channel from the fourth wall to a termination point, wherein, the termination point being located at a first distance from the fifth reference plane, as measured normally relative to the fifth reference plane, the first inflection point being located at a second distance from the fifth reference plane, as measured normally relative to the fifth reference plane, the first distance being greater than the second distance, wherein, the second channel wall defines a second inflection point between the fourth wall and the termination point, the second inflection point representing the closest point of the second channel wall to the first reference plane, as measured normally relative to the first reference plane; and, a pocket extending from the channel, the pocket having a first pocket portion protruding from the first channel reference plane in a direction generally towards the first reference plane, wherein, a throat height is defined between: i. a sixth reference plane disposed normally to the primary reference axis to coincide with the first inflection point; and, ii. a seventh reference plane disposed normally to the primary reference axis to coincide with the second inflection point, and, wherein, the tongue profile height is greater than the throat height.

2. The flooring element of claim 1, wherein, the first and second shank side surfaces diverge in a direction away from the base along the first reference axis.

3. The flooring element of claim 1, wherein the flooring element is one of a tile, plank, or board.

4. The flooring element of claim 1, wherein the hook defines an end wall extending from the free end towards the second reference plane.

5. The flooring element of claim 4, wherein a secondary end wall extends between the end wall and the junction.

6. The flooring element of claim 5, wherein the secondary end wall is indented towards the first reference plane.

7. The flooring element of claim 1, wherein the first end edge portion includes a tongue similarly formed to the tongue of the first side edge portion, and the second end edge portion includes a groove similarly formed to the groove of the second side edge portion.

8. The flooring element of claim 1, wherein the body is at least partially formed of wood.

9. The flooring element of claim 1, wherein the body is at least partially formed of synthetic material.

* * * * *